US009897269B2

(12) United States Patent
Thomas et al.

(10) Patent No.: US 9,897,269 B2
(45) **Date of Patent: *Feb. 20, 2018**

(54) LED LIGHT FIXTURE

(71) Applicant: ElectraLED Inc., Largo, FL (US)

(72) Inventors: James Thomas, Tierra Verde, FL (US); David Lynd, Seminole, FL (US)

(73) Assignee: ElectraLED Inc., Largo, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/483,472

(22) Filed: Apr. 10, 2017

(65) Prior Publication Data

US 2017/0211762 A1 Jul. 27, 2017

Related U.S. Application Data

(63) Continuation of application No. 15/231,173, filed on Aug. 8, 2016, now Pat. No. 9,618,187, which is a (Continued)

(51) Int. Cl.
*F21V 29/00* (2015.01)
*F21S 2/00* (2016.01)
(Continued)

(52) U.S. Cl.
CPC ..... *F21S 2/005* (2013.01); *F21K 9/69* (2016.08); *F21V 23/02* (2013.01); *F21V 29/767* (2015.01);
(Continued)

(58) Field of Classification Search
CPC ..... F21S 2/005; F21V 29/767; F21V 29/773; F21V 23/02; F21K 9/69
See application file for complete search history.

(56) References Cited

U.S. PATENT DOCUMENTS 7,052,171 B1 5/2006 Lefebvre et al.
7,274,302 B2 9/2007 Stevenson et al.
(Continued)

OTHER PUBLICATIONS

PCT/US2012/029934 International Search Report and Written Opinion of the International Searching authority dated Jul. 13, 2012.

*Primary Examiner* — Thomas M Sember
(74) *Attorney, Agent, or Firm* — McDermott Will & Emery LLP

(57) ABSTRACT

An LED light fixture is provided and includes a housing having a main body portion with a rear wall. A plurality of fins integrally extends from an outer surface of the rear wall of the main body portion. A spindle with an internal bore integrally extends from the outer surface of the rear wall of the main body portion wherein the spindle is positioned among the fins. A light engine assembly is positioned within the main body portion and includes a plurality of LED light modules mounted to a printed circuit board. Each module comprises a LED and a lens extending from the printed circuit board, wherein the printed circuit board resides against an inner surface of the rear wall. A separate enclosure configured to enclose power management components is connected to a rear portion of the housing proximate the fins. The enclosure includes a housing wall arrangement and leads that extend through both an opening in the housing wall and the internal bore of the spindle, past the rear wall of the main body portion and to the printed circuit board.

11 Claims, 13 Drawing Sheets

Related U.S. Application Data continuation of application No. 14/851,084, filed on Sep. 11, 2015, now Pat. No. 9,410,690, which is a continuation of application No. 14/543,622, filed on Nov. 17, 2014, now Pat. No. 9,134,019, which is a continuation of application No. 13/567,488, filed on Aug. 6, 2012, now Pat. No. 8,888,325, which is a continuation of application No. 12/454,436, filed on May 18, 2009, now Pat. No. 8,235,555, which is a continuation-in-part of application No. 11/818,216, filed on Jun. 13, 2007, now Pat. No. 7,651,245.

(51) Int. Cl.

| | |
|---|---|
| ***F21V 29/76*** | (2015.01) |
| ***F21V 29/77*** | (2015.01) |
| ***F21K 9/69*** | (2016.01) |
| ***F21V 23/02*** | (2006.01) |
| *F21Y 115/10* | (2016.01) |
| *F21V 31/03* | (2006.01) |
| *F21V 21/30* | (2006.01) |

(52) U.S. Cl.

CPC ..... *F21V 29/773* (2015.01); *F21V 21/30* (2013.01); *F21V 31/03* (2013.01); *F21Y 2115/10* (2016.08)

(56) References Cited

U.S. PATENT DOCUMENTS

| | | | |
|---|---|---|---|
| 7,431,477 | B2 | 10/2008 | Chou et al. |
| 7,438,448 | B2 | 10/2008 | Chen |
| 7,722,230 | B2 | 5/2010 | Chien |
| 7,841,752 | B2 | 11/2010 | Lee |
| 7,866,850 | B2 | 1/2011 | Alexander et al. |
| 7,985,005 | B2 | 7/2011 | Alexander et al. |
| 2005/0128752 | A1 | 6/2005 | Ewington et al. |
| 2005/0254263 | A1 | 11/2005 | Harwood |
| 2007/0228999 | A1 | 10/2007 | Kit |
| 2008/0037239 | A1 | 2/2008 | Thomas et al. |
| 2008/0212333 | A1 | 9/2008 | Chen |
| 2009/0086481 | A1 | 4/2009 | Wegner |
| 2010/0148673 | A1 | 6/2010 | Stewart et al. |

FIG. 1
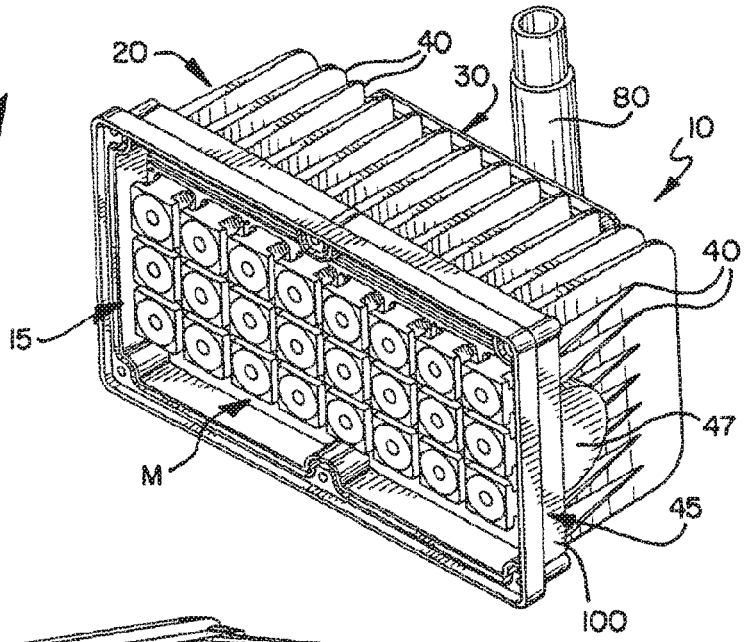
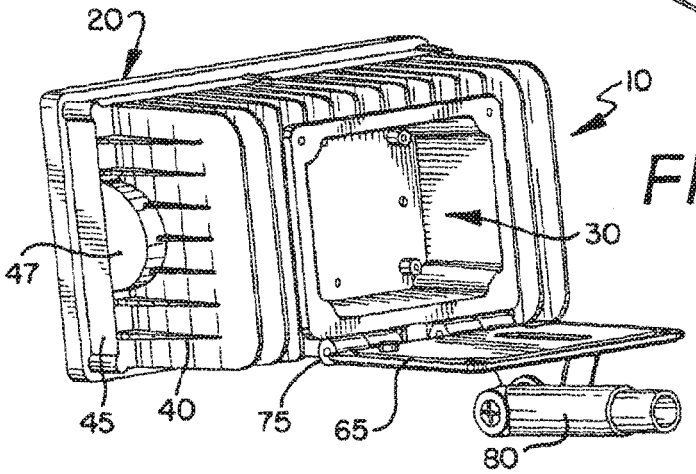
FIG. 2
FIG. 3
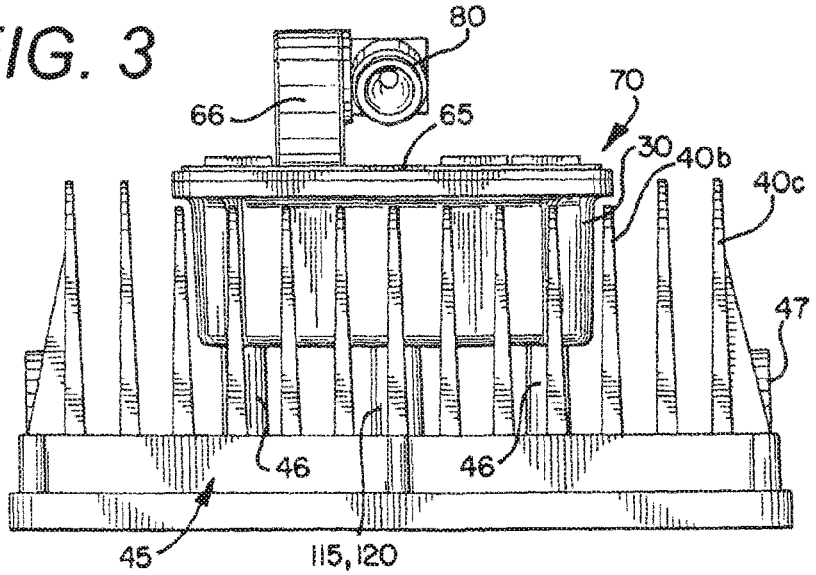

LED LIGHT FIXTURE

CROSS-REFERENCE TO RELATED APPLICATION

This is a continuation of U.S. patent application Ser. No. 15/231,173, filed Aug. 8, 2016, now U.S. Pat. No. 9,618,187, which is a continuation of U.S. patent application Ser. No. 14/851,084, filed Sep. 11, 2015, now U.S. Pat. No. 9,410,690, which is a continuation of U.S. patent application Ser. No. 14/543,622, filed Nov. 17, 2014, now U.S. Pat. No. 9,134,019, which is a continuation of U.S. Pat. No. 13/567,488, filed Aug. 6, 2012, now U.S. Pat. No. 8,888,325, which is a continuation of U.S. patent application Ser. No. 12/454,436, filed May 18, 2009, now U.S. Pat. No. 8,235,555, which is a continuation-in-part of U.S. patent application Ser. No. 11/818,216, filed Jun. 13, 2007, now U.S. Pat. No. 7,651,245, the entire contents of which are hereby incorporated by reference in their entirety.

FEDERALLY SPONSORED RESEARCH OR DEVELOPMENT

N/A

TECHNICAL FIELD

The invention relates to a multi-use durable light fixture with improved thermal management properties to ensure reliable operation. More specifically, the light fixture includes a light engine featuring an arrangement of light emitting diodes (LEDs), a rugged high thermal performance housing featuring improved thermal performance through the use of an air flow passageway, and an external power supply removeably embedded within an optional external enclosure.

BACKGROUND OF THE INVENTION

Light fixtures suitable for commercial use, such as in or around buildings and commercial facilities, are typically designed to be durable since they can be struck or damaged during business operations. To provide this durability, existing light fixtures typically have substantial housings that protect the light source. Most existing commercial light fixtures utilize fluorescent bulbs, halogen bulbs, mercury vapor lamps, or metal halide lamps as the light source. However, these existing commercial fixtures suffer from a variety of limitations, including but not limited to high cost, low efficiency, high power consumption and/or poor light output quality. Other commercial fixtures may utilize LEDs, however, the heat generated by the LEDs during operation compromises the performance, lifetime and efficiency of these fixtures. Thus, the overall appeal of existing commercial fixtures is limited, and will further erode as energy costs (and the related operating costs) continue to increase.

The present invention is provided to solve limitations found in the conventional light fixtures and systems, and to provide advantages and aspects not provided by conventional designs. A full discussion of the features and advantages of the present invention is deferred to the following detailed description, which proceeds with reference to the accompanying drawings.

SUMMARY OF THE INVENTION

The present invention is directed to a light fixture that includes an LED light engine, which by design, is energy efficient and provides high quality light output. The inventive light fixture includes a rugged housing, a power supply that may be removeably mounted inside an external enclosure and an air flow passageway across the light engine whereby air flows along the passageway during operation of the light fixture. The rugged housing is of particular importance when the light fixture is configured for use in high-traffic commercial or industrial applications, such as warehouses, loading docks or shipping/receiving areas, where the light fixture is prone to be stricken by forklifts and other large objects. The light fixture includes several novel heat management features designed to thermally isolate the power supply and light engine in order to reduce the risk of failure and thereby increase the reliability of the light fixture.

According to an aspect of the invention, the light fixture includes a rugged housing, a light engine assembly and an air flow passageway through a central inlet across the light modules and out a rear vent whereby air flows along the passageway during operation of the light fixture. The housing also includes an arrangement of fins extending rearward from a main body portion of the housing along a spindle that dissipate heat.

According to another aspect of the invention, the light engine comprises a printed circuit board (PCB), a plurality of LED modules, and a lens extending outward from each module. Each module comprises a LED and a zener diode, which results in "bypass" circuitry to prevent catastrophic failure of the light engine. The light engine further comprises a heat transfer element, such as a thermal pad, positioned between the circuit board and the housing. The modules are divided into multiple groups, where each group includes multiple modules. Within each group, the modules are serially arrayed, and the groups are parallel to each other to facilitate current sharing from the power supply.

One aspect of using the light fixture of the present invention in a track light system including an elongated track is that many more light fixtures may be connected to the track than is possible with conventional incandescent or halogen light fixtures. The copper bus wire runs that are contained within a commercial track are predominantly limited to a maximum of twenty amps of current per circuit. The current required for an incandescent or halogen light fixture is much higher than the current required for an LED light fixture, thus many more LED light fixtures can be connected to the same track system. For example, a 120 watt incandescent light fixture will require about one amp of current, and a maximum of twenty incandescent light fixtures may be connected to a twenty amp circuit. However, a twenty watt LED light fixture will require about 0.167 amps of current, and a maximum of 120 LED light fixtures may be connected to a twenty amp track circuit. This example illustrates a five fold increase in the number of light fixtures that can be connected to a single track circuit. The total cost of the track system infrastructure is greatly reduced due to the requirement for fewer electrical feeds, breakers and light track circuits.

Another aspect of the inventive LED light fixture may easily replace or retrofit older incandescent track technology with the newer LED technology. The task simply requires unplugging the older light fixtures from the track and plugging in the newer LED light fixtures. Other advantages in addition to the reduced power required for the track lighting system include: less heat generated, less heat load on building cooling systems, longer operating life, reduced lighting maintenance costs, rugged impact resilient design, less breakage, environmentally friendly design with no mercury or lead being used in production and an aesthetically pleasing design.

For a more complete understanding of the present invention, its operating advantages and the specific objects attained by its uses, reference should be had to the accompanying drawings as well as the descriptive matter in which there is illustrated and described the preferred embodiment of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a first embodiment of the light fixture of the invention;

FIG. 2 is a perspective view of the light fixture of FIG. 1, showing the rear cover of the fixture in the open position to expose a box that receives a power supply;

FIG. 3 is a top view of the light fixture of FIG. 1, showing a power module received within a receptacle defined by an array of fins;

DESCRIPTION OF THE PREFERRED EMBODIMENT

Figure 4:
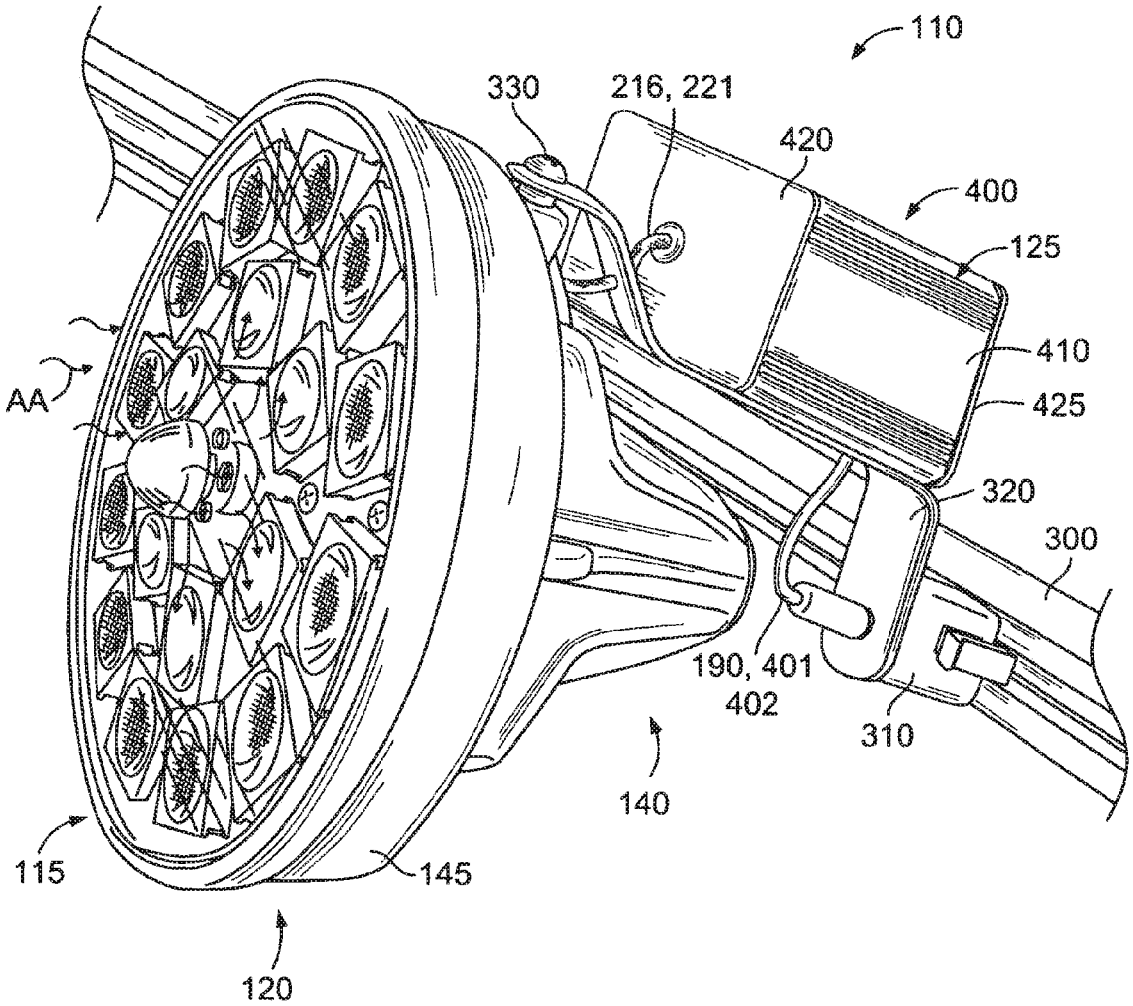
FIG. 4 is a perspective view of another embodiment of the light fixture of the invention, showing the light fixture connected to an elongated track.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-3 show a first embodiment of a light fixture 10 of the present invention. The light fixture 10 includes a light engine assembly 15 featuring an arrangement of light emitting diodes (LEDs) 17, a rugged housing 20, an internal power supply 25 removably embedded within a box 30 of the housing 20, wherein the box 30 encloses the power supply 25 within the housing 20. This embodiment of the light fixture 10 is configured for use in commercial or industrial applications, such as loading docks or receiving areas. In these high-traffic areas, conventional light fixtures, which include an externally-mounted power supply, are prone to being struck by forklifts and other large objects. By positioning the power supply 25 within the housing 20, the inventive fixture 10 reduces both (a) the overall dimensions of the light fixture 10, and (b) the incidence of damage to the power supply 25. However, the embedded power supply 25 then becomes susceptible to failure from heat generated by the light engine 15. To combat this, the light fixture 10 includes several heat management components, including the housing 20 itself, to dissipate heat from the light engine 15 and to thermally isolate the power supply 25. Individually and collectively, the heat management components increase the reliability of the light fixture 10, including the light engine 15 and the power supply 25.

The light fixture 10 further includes a rectangular lens 35 secured to the housing 20 by a plurality of fasteners 36, and a gasket 37. The housing 20 includes an arrangement of external fins 40 that help the housing 20 dissipate heat generated by the light engine 15. The fins 40 extend from a main body portion 45 of the housing 20 which includes that portion of the housing 20 that engages the lens 35 and the light engine 15. The main body 45 includes a curvilinear protrusion 47 proximate side fins 40 (see FIGS. 1-3). The light engine 15 comprises a printed circuit board (PCB) 50, a plurality of LED modules M, and a lens 55 extending outward from each module M. The light engine 15 further comprises a heat transfer element 60, for example a thermal pad 61, positioned between the rear surface of the circuit board 50 and the housing 20. The circuit board 50 and the heat transfer element 60 are secured to the housing 20 by at least one fastener 51. In contrast to existing lighting devices that employ LEDs, the present light fixture 10 does not require a reflector(s) to focus or disperse the light pattern generated by the LEDs. As a result, the dimensions of the housing 20 are reduced while still allowing for the internal power supply 25. Although not shown, the housing's main body 45 may include a vent to reduce fogging of the lens 35 in harsh or damp operating environments.

As mentioned above, the housing 20 also includes a power supply box 30 that receives the power supply 25. Preferably, the power supply 25 is of the universal input, constant current output and switching variety. The box 30 includes a cover segment 65 that is operably connected to the box 30 to allow for movement of the cover 65 and to provide for insertion and removal of the power supply 25. Thus, the power supply 25 can be repaired or replaced when the light fixture 10 malfunctions. FIG. 2 depicts the light fixture 10 in an open position P1, wherein the rear cover 65 is opened to expose the power supply 25. Since the cover 65 is operably connected to the box 30 to enclose the power supply 25, these three components define a power module 70 that is thermally isolated from the heat generated by the light engine 15 and dissipated by the housing 20. A hinge 75 is formed between the box 30 and the cover 65 to allow for pivotal movement of the cover 65. Alternatively, the cover 65 is operably connected to the box 30 by alternate securing means, such as a pin and socket arrangement or sliding channel arrangement. A tether 76, secured by fasteners 77 and washers 78, extends between the box 30 and the cover 65 to prevent over-rotation of the cover 65. Fasteners 79 extend through the upper portion of the cover 65 to further secure the cover 65 to the box 30. The rear cover 65 further includes an elongated arm 80 that is used to mount the light fixture 10 to a support surface. The arm 80 is adjustably connected to a sub-base 66 of the rear cover 65 by an adjustment screw 67 and an O-ring 68. The arm 80 is tubular to allow for the passage of electrical leads, namely the main power leads 85 and a ground lead 90. Because the power supply 25 is internal to the housing 20, the rear cover 65 includes an opening 69 that allows for the passage of the power and grounds leads 85, 90 for connection to the power supply 25.

FIGS. 4-12 show a second embodiment of a light fixture 110 of the present invention. The light fixture 110 includes a light engine assembly 115 featuring an arrangement of light emitting diodes (LEDs) 170, a rugged housing 120 and an external power supply 125 removably residing within an external enclosure box 400 to form a power module. This embodiment of the light fixture 110 is configured for use in track lighting systems but in place of conventional track lighting fixtures. This embodiment of the light fixture 110 also provides a rugged, low power, long life, high efficiency, high lumen output light source that may be used in commercial or industrial applications, such as loading docks or receiving areas. By positioning the power supply 125 either within the external enclosure box 400 or mounting it separately from the light fixture 110, the inventive fixture 110 reduces the incidence of damage to the power supply 125 and helps prevent failure from heat generated by the light engine 115. To increase its performance and durability, and minimize issues arising from heat generated by the light engine 115, the light fixture 110 includes several novel heat management features for the housing 120. These features include pronounced cooling fins 140, air inlets 142 in the lens cover 135 and cooling vents 144 between each cooling fin 140 to allow for additional air flow across light engine 115. Individually and collectively, the heat management components increase the reliability of the light fixture 110, including the light engine 115 and the power supply 125.

Figure 8:
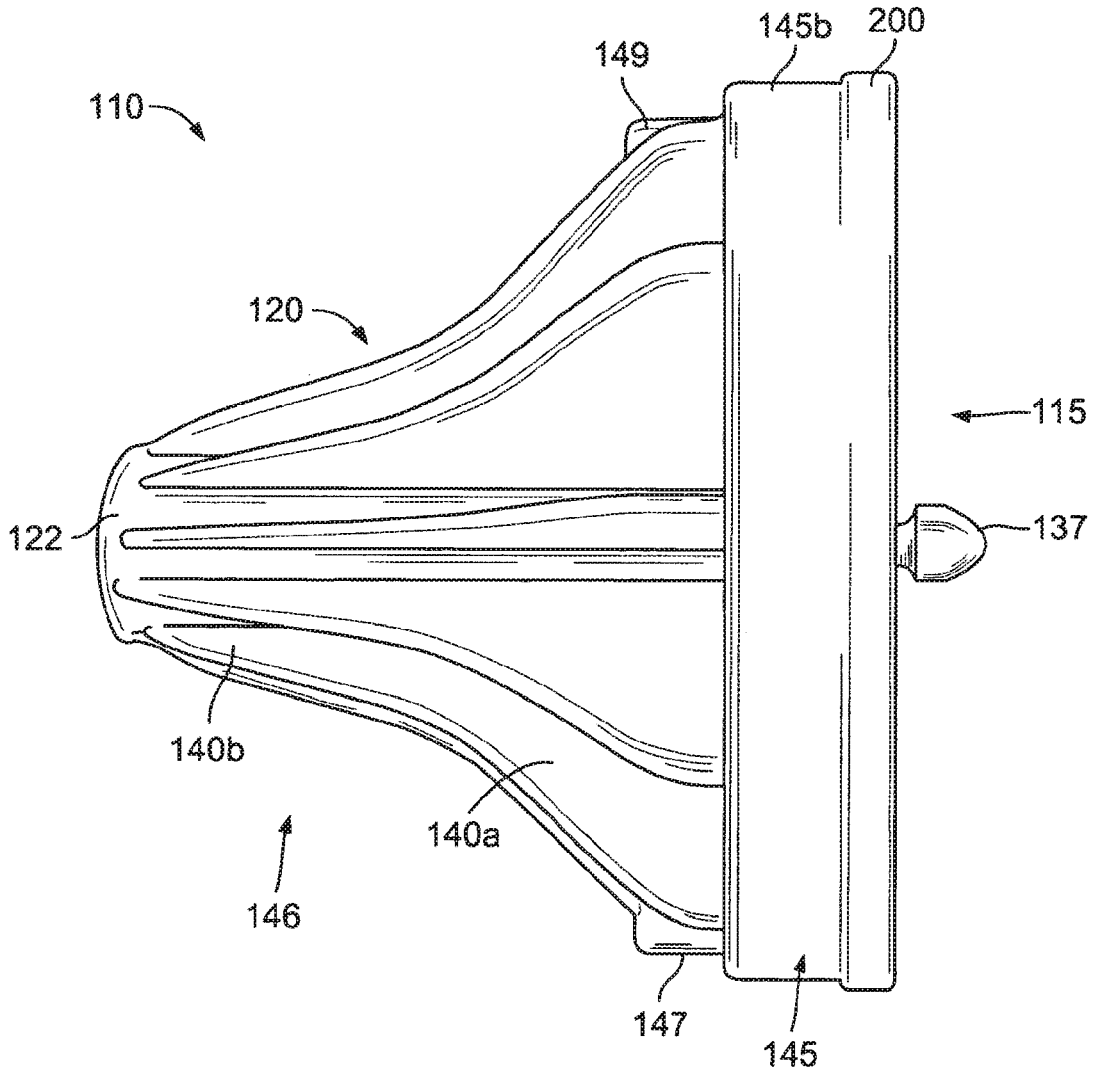
FIG. 8 is a first side view of the light fixture of FIG. 4.
Figure 8A:
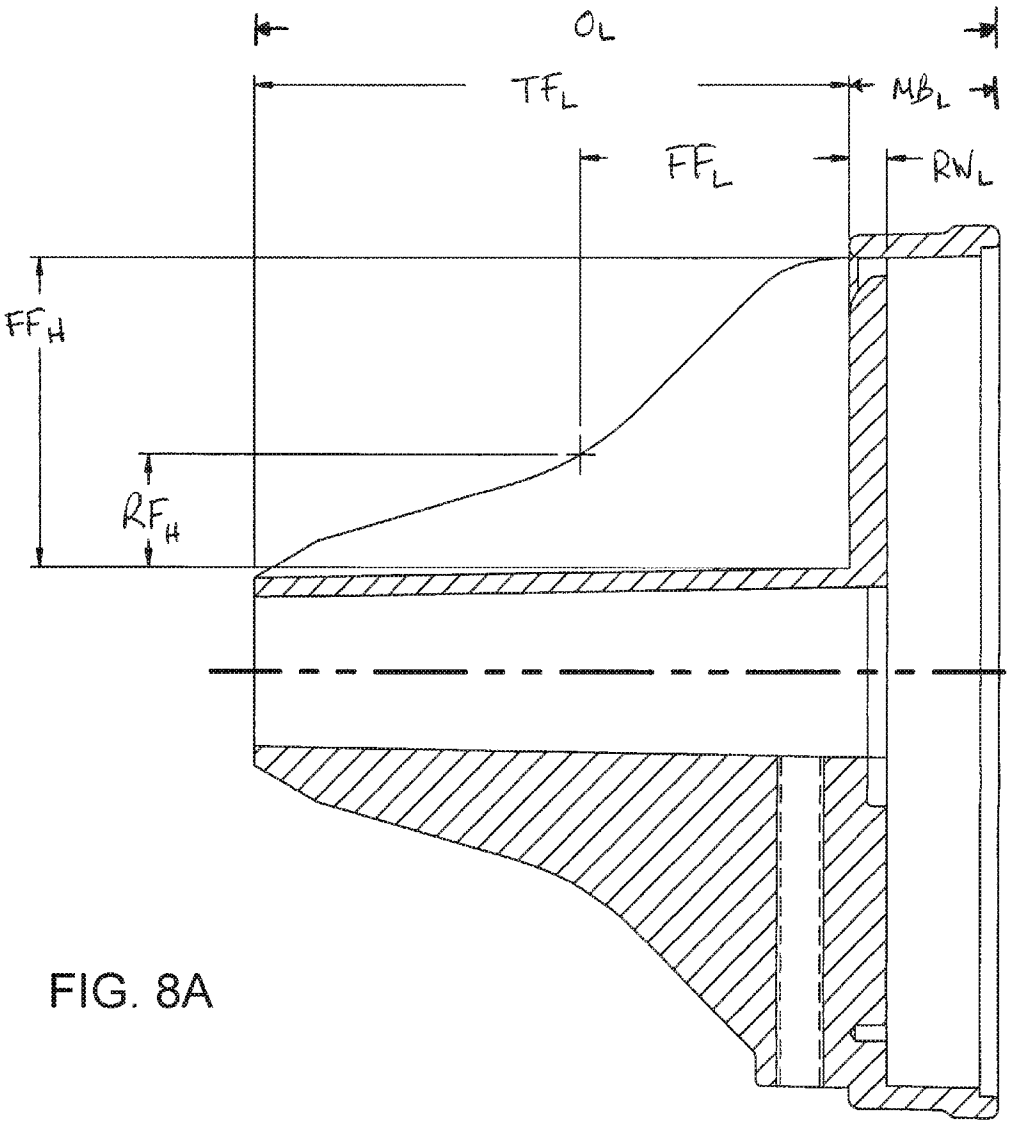
FIG. 8A is a cross-section of the light fixture of FIG. 4, taken along line A-A of FIG. 7A.

The housing 120 has a spindle 122 extending rearward from the front of the light fixture 110. The spindle 122 includes a central bore or passageway 136 that receives a mounting shaft 141 that secures the lens cover 135 to the housing 120 by engagement with a mounting nut 137 (as described below). The central passageway 136 also receives power supply leads 216, 221 extending from the power supply 125 to the circuit board 150. The arrangement of external fins 140 help the housing 120 dissipate heat generated by the light engine 115 and extend rearward from a main body portion 145 along the spindle 122. Thus, the spindle 122, the fins 140 and the main body portion 145 collectively provide a thermal dissipation mass rearward of the light engine 115. Preferably, the fins 140 are tapered in both thickness and height as they extend rearward from the front of the light fixture 110. As they extend rearward from the main body portion 145, the fins 140 truncate and merge with the spindle 122 near its distal end. Preferably, the arrangement of the fins 140 is symmetrical to allow optimum thermal performance in any orientation, while increasing the aesthetic appearance of the housing 120. Due to the tapering, each fins 140 has a front portion 140*a* and a rear portion 140*b*, where the demarcation point is slightly rearward of the mid-length of the fin 140 (as shown in FIG. 8A). The front fin portion 140*a* has a leading edge 140*c* that is in contact with a rear wall 145*a* of the main body portion 145, and the rear fin portion 140*b* terminates proximate the rear end of the spindle 122.

In the embodiment of FIGS. 4-12, the front fin portion 140*a* has a major height $FF_H$ of 45-55 mm, and preferably 52 mm; a thickness $FF_T$ of at least 4 mm, and preferably 5 mm; and a length $FF_L$ of at least 40 mm, and preferably 45 mm. Due to the fin tapering, the rear fin portion 140*b* has a major height $RF_H$ of at least 15 mm, and preferably 18 mm; a thickness $RF_T$ of at least 1 mm, and preferably 2 mm; and a length $RF_L$ of at least 50-60 mm, and preferably 55 mm. Referring to the embodiment of FIG. 8, the front and rear fin portions 140*a, b* provide an overall fin length $F_L$ that far exceeds a main body length $MB_L$ (which is approximately 25 mm), both of which exceed a rear wall length $RW_L$. Based upon the configuration of the front and rear fin portions 140*a, b*, the fin length $F_L$ is a major extent of the overall length $O_L$ of the fixture 110. Although the fins 140 in the embodiment of FIGS. 4-12 are uniformly dimensioned, in another embodiment, at least one fin 140 has a reduced length $F_L$ (for example, no rear fin portion 140*b*) whereby that fin 140 terminates and merges with the spindle 122 further from the distal end of the spindle 122.

Figure 5:
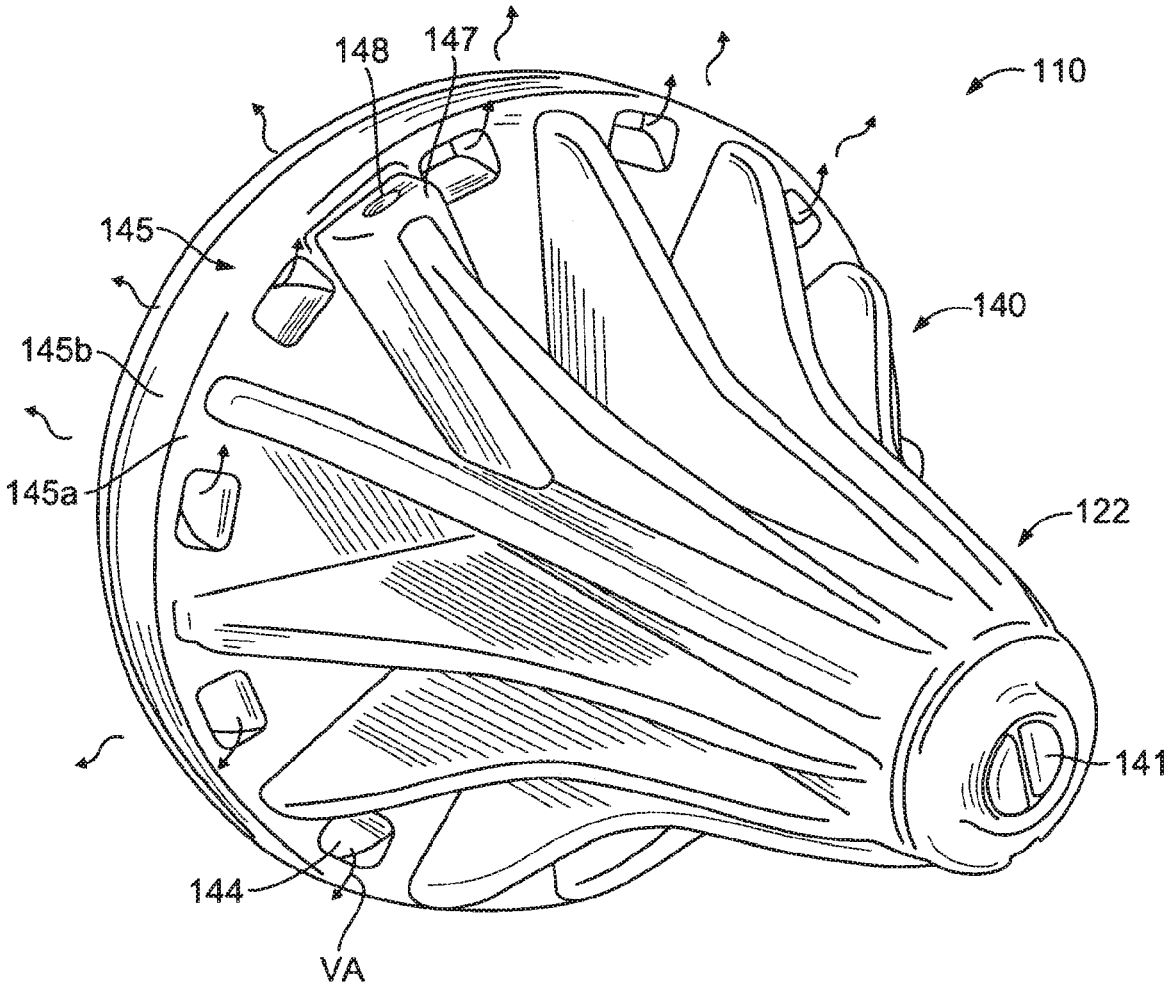
FIG. 5 is a rear perspective view of the light fixture of FIG. 4.
Figure 6:
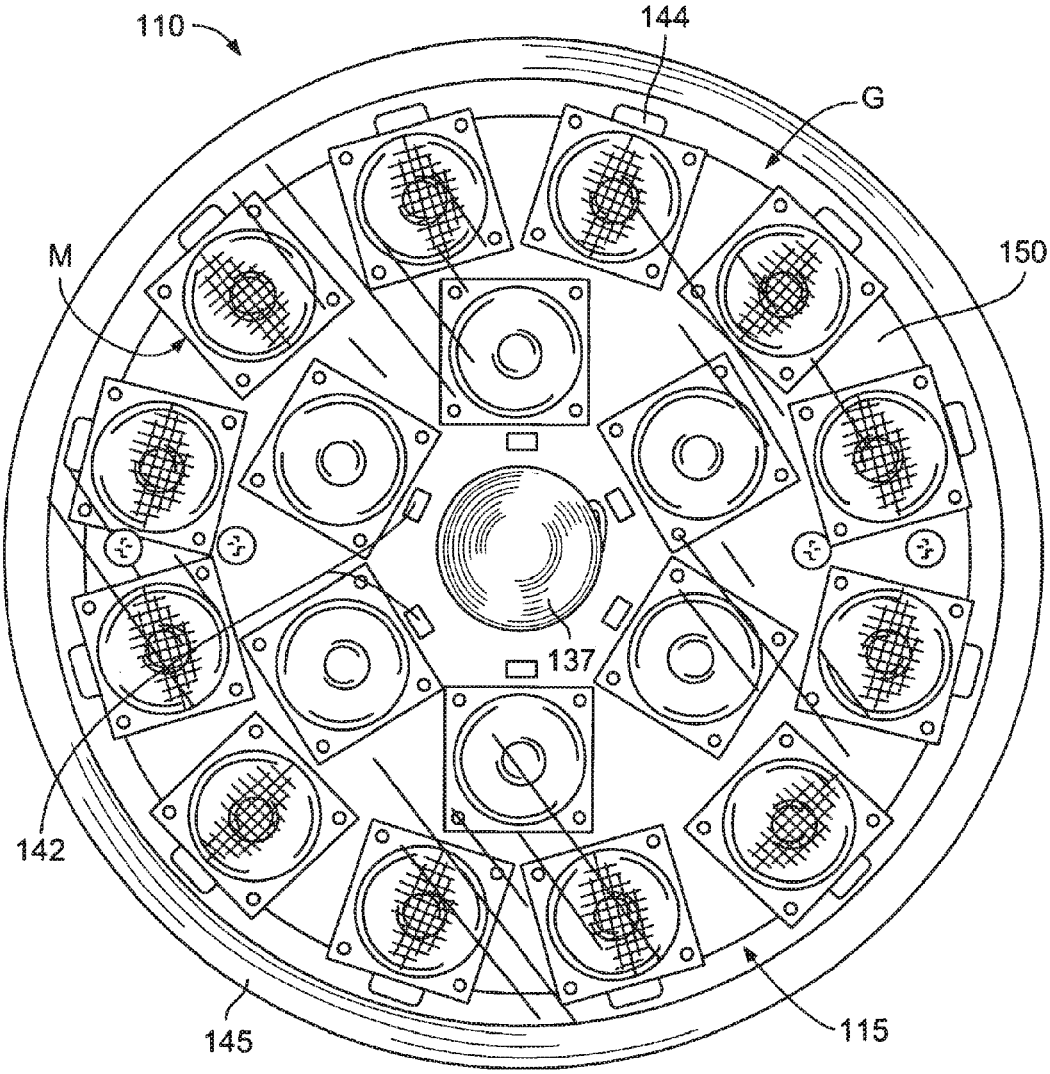
FIG. 6 is a front view of the light fixture of FIG. 4.
Figure 7:
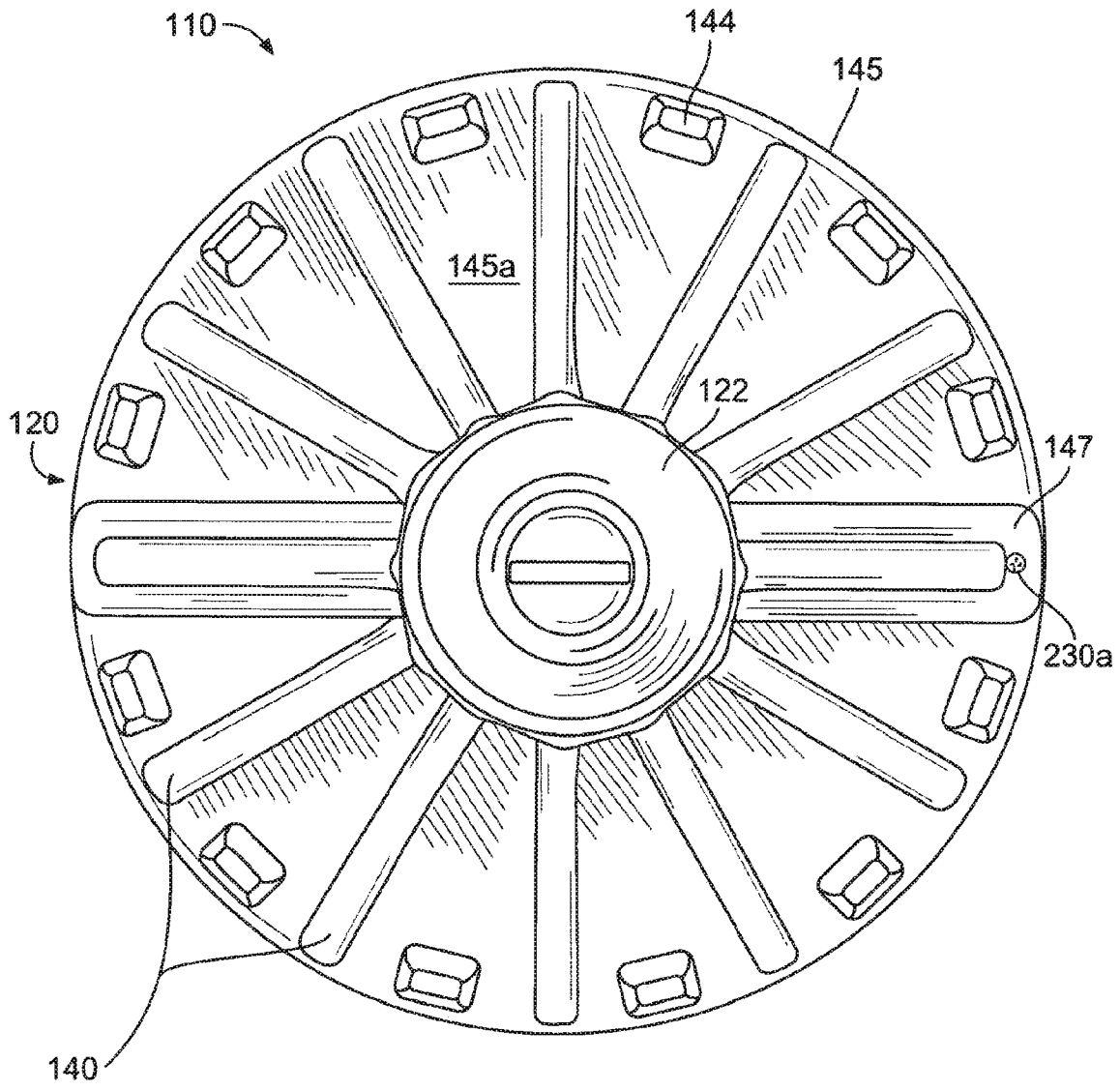
FIG. 7 is a rear view of the light fixture of FIG. 4.
Figure 7A:
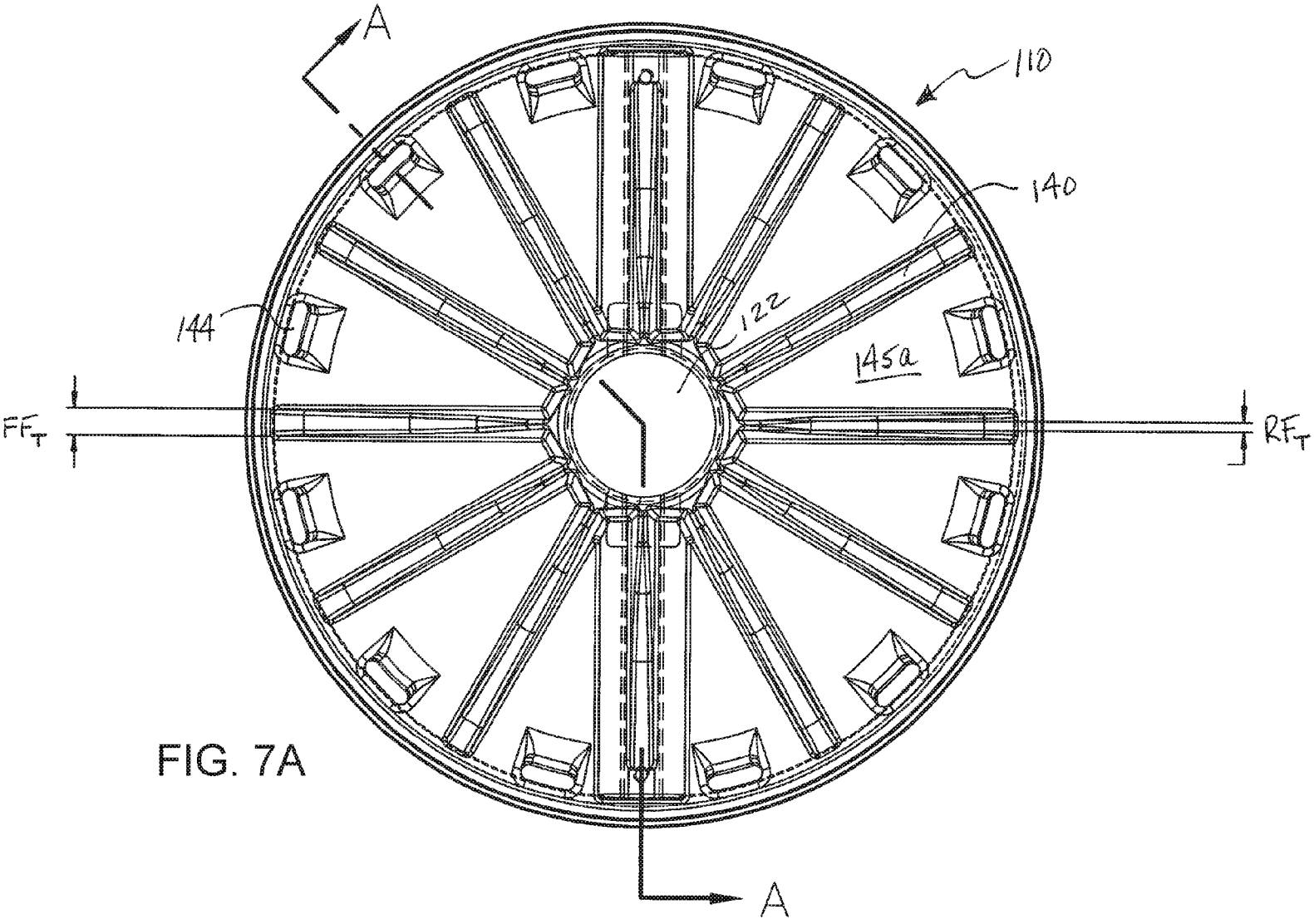
FIG. 7A is a second rear view of the light fixture of FIG. 4.
Figure 12:
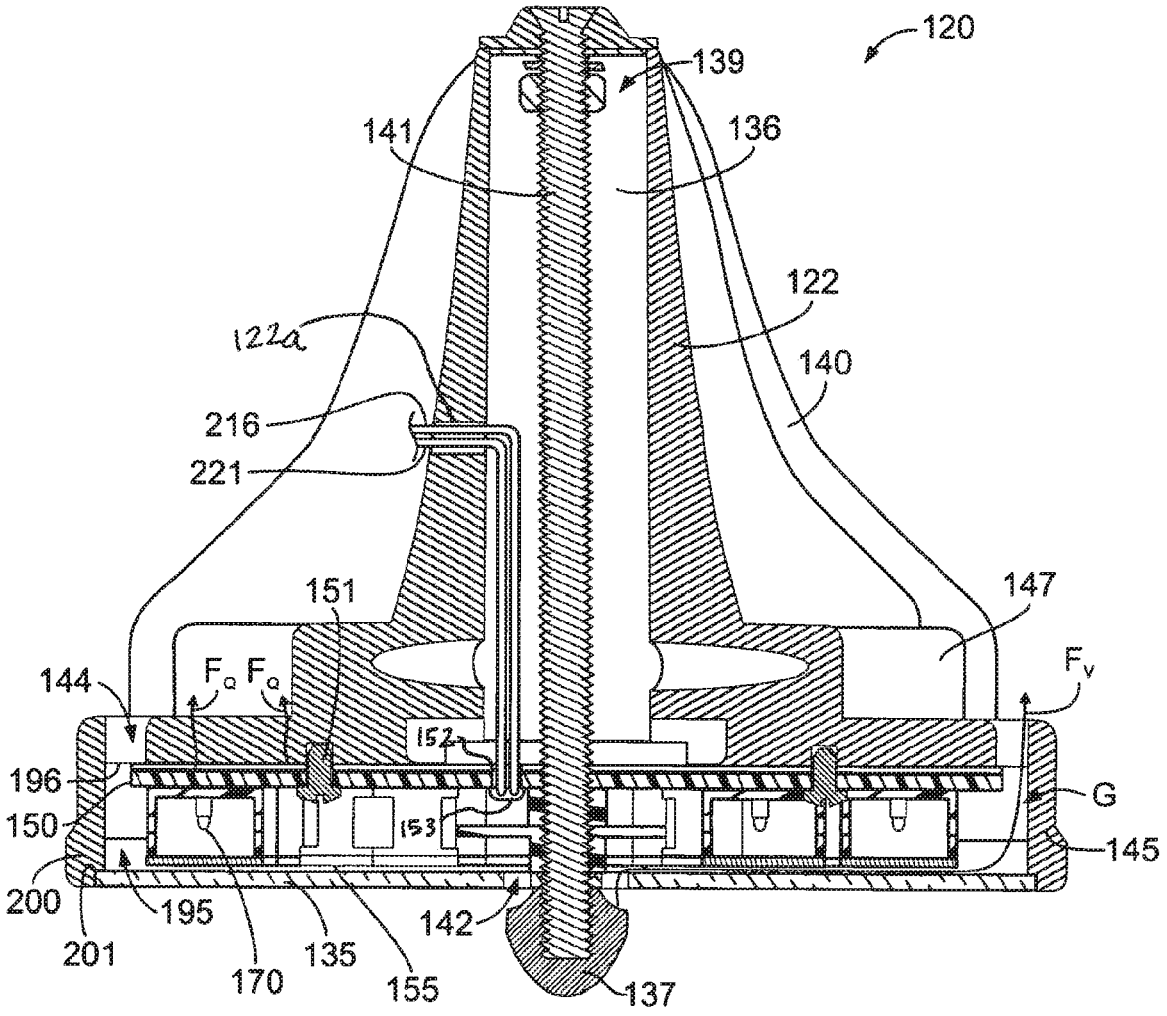
FIG. 12 is a cross-section of the light fixture of FIG. 4, showing the light fixture in an assembled position; and, FIG. 13 is a partial cross-section of an another embodiment of the invention, showing the light fixture in a down light installation.

As shown in FIGS. 5-7, the housing 120 has at least one vent 144, and preferably a plurality of vents 144, in the main body portion 145. The vents 144 are formed in a rear wall 145*a* of the main body portion 145 (see FIG. 5), at the periphery of the rear wall 145*a*, and circumferentially around the spindle 122. Referring to FIGS. 6 and 12, the vents 144 are positioned beyond or radially outward of the circuit board 150 and the modules M. Alternatively, the vents 144 are formed in a side wall 145*b* of the main body portion 145. The vent 144 is located between the leading edge of a pair of fins 140, wherein there is a one to one relationship between the number of fins 140 and vents 144. Referring to FIGS. 1, 2, 5, 6, at least one mounting protrusion 147 is positioned proximate a fin 140 and the main body portion 145. The protrusion 147 may include means for coupling with a fastener, such as threaded hole 148 that receives a fastener 230 for mounting the light fixture 110 to various styles of brackets 320. For example, FIG. 4 shows that a protrusion 147 with hole 148 is used to mount the light fixture 110 to a single bracket 320. A second mounting protrusion 149 (see FIG. 8), opposite the first mounting protrusion 147, can be employed to mount the light fixture 110 to a U-bracket mount. A set screw 230*a* may be inserted into the housing 120, preferably the protrusion 147, to further secure the fastener 230 into position and prevent it from backing out as the light fixture 110 is rotated or adjusted.

The main body portion 145 is a frontal segment of the housing 120 that engages the lens cover 135 and the light engine 115. As shown in the cross-section view of FIG. 12, the main body 145 has an inwardly extending receiver 195 defined by a flange 200. The receiver 195 provides a primary mounting surface 196 for the light engine 115, while the flange 200 provides a secondary mounting surface 201 for the lens 135. There are a plurality of holes on the mounting surface 196 of the inward extending receiver 195 to allow attachment of the light engine 115 and thermal pad 161 by a fastener 151 that extends through the circuit board 150 and the heat transfer element 60. The mounting surface 196 is flat and unpainted to provide an optimum thermal interface between the light engine 115, heat transfer element 160 (e.g., the thermal pad 161) and aluminum housing 120. All areas of the housing 120, other that the mounting surface 196, are designed to be painted or powder coated, with the required thermal performance maintained after the painting. The heat transfer element 160 is positioned between a rear surface of the circuit board 150 and the primary mounting surface 196 to facilitate heat transfer. The housing 120 is a uniquely shaped, die cast head made from aluminum or a polymer with metal fibers to provide electrical and thermal conductivity. In another embodiment, the housing 120 is made from a CoolPoly thermally conductive plastic which is a thermoplastic resin with the ability to transfer heat. The resin provides the ability to be either electrically insulative or electrically conductive, is up to 150% lighter than aluminum and is net shape moldable and can provide greater design freedom.

Figure 11:
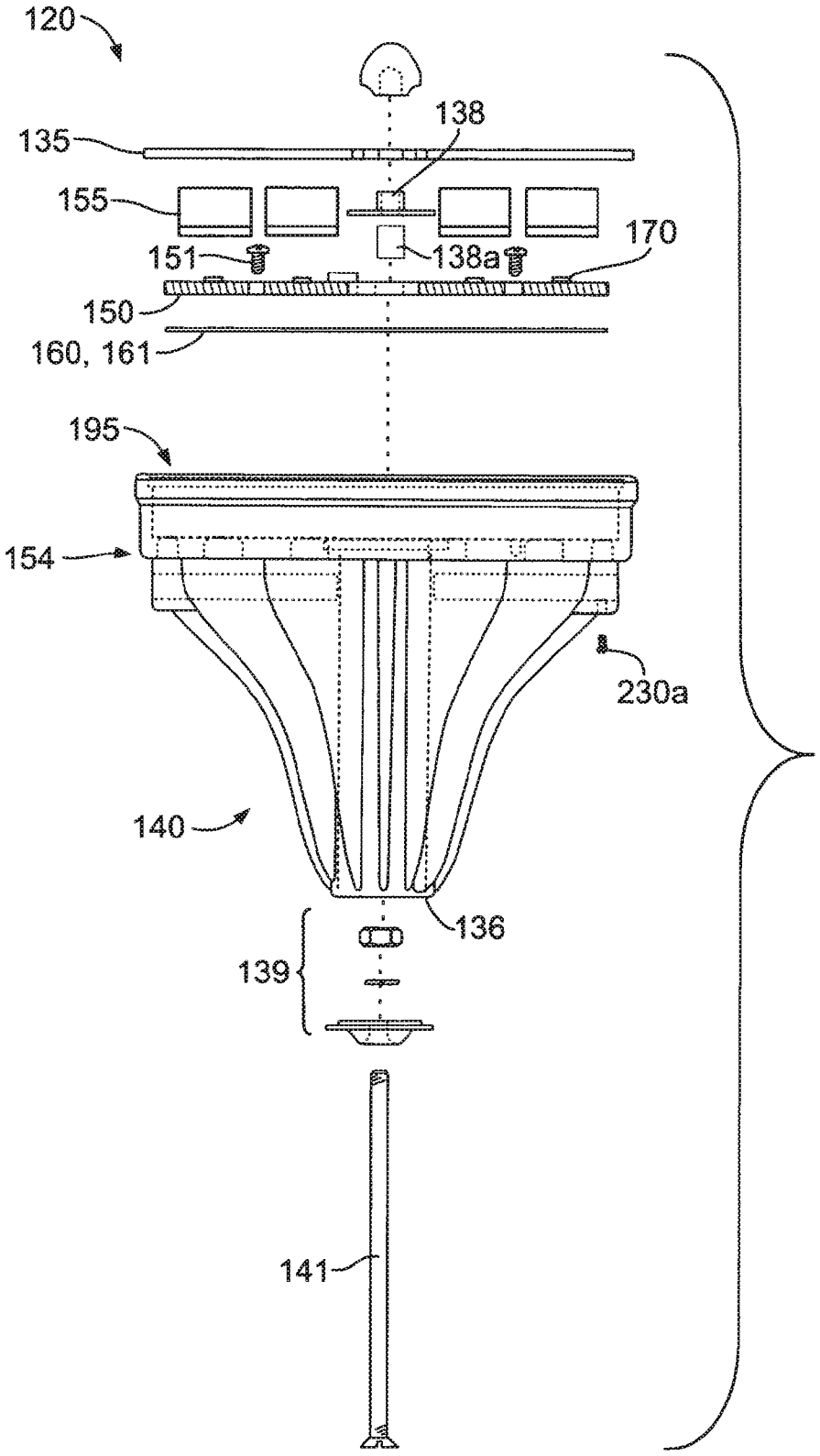
FIG. 11 is an exploded view of the light fixture of FIG. 4, showing the various components of the light fixture including a light engine, a housing, and a front lens cover.

The light fixture 110 further includes a lens cover 135 (also known as a single molded optical lens) used to cover and protect the LEDs 170 and the light engine 115. The lens cover 135 can be made of polycarbonate, acrylic or other suitable transparent or translucent material which is cut from flat extruded sheet stock or be injection molded. The lens cover 135 can be water clear or diffused to help reduce glare. It may also act as both an optical lens and a protective cover functioning as a light pipe to collimate the light at a desired point. The lens cover 135 has one hole 135*a*, preferably in the center of the cover 135, which is used for attaching the lens cover 135 to the housing 120 housing via mounting hardware. As shown in FIGS. 11 and 12, the mounting hardware includes a mounting nut 137, a front guide washer 138 and spacer 138*a*, a rear securing assembly 139 and the mounting shaft 141. The rear securing assembly 139 includes a rear cover plate 122*a* that mates with the rear end of the spindle 122. The mounting shaft 141 extends through the bore 136, a central opening 160*a* of the heat transfer element 160, and a central opening 150*b* of the circuit board 150 to engage the mounting nut 137. The front portion of the shaft 141 also extends between modules M of the light engine 115 and through the hole 135*a* of the cover for reception with the nut 137. The lens cover 135 also has at least one inlet 142 positioned radially outward of the hole 135*a* and the nut 137. Preferably, the cover 135 has a plurality of central inlets 142 arranged radially outward of the hole 135*a* and within the periphery of the cover 135. As explained below, the inlets 142 allow for the entry of air into the housing 120 and the light engine 115.

The light engine 115 comprises a printed circuit board (PCB) 150 and a plurality of LED modules M, wherein each module M includes a LED 170 and a zener diode 180. As shown in FIG. 6, the light engine 115 comprises an outer ring of twelve modules M (including the LED 170) and an inner ring of six modules M angularly offset (as measured from the center of the lens cover 135) from the outer ring to facilitate a uniform light pattern and uniform heat generation during operation of the fixture 110. A lens 155 is placed over each module M in order to focus the wide angular dispersion of light coming from the module M. The lens 155 may be a unitary structure, or it may include openings in its side wall. Various combinations of lenses, including narrow, medium and wide beam lenses, can be utilized in order to create different angular dispersions of light and different luminous intensities. For example, the outer ring of modules M may use wide beam lenses and the inner ring of modules M may use medium beam lenses, wherein this combination create a light source that washes a wide area with light but has extra intensity in the middle. This particularly useful for a track light fixture application, where the fixture is generally used to illuminate a specific object, but also must wash the area around the object with less intense light. Alternatively, all narrow lenses can be used to create a spot light, or all wide lenses can be used to create a flood light depending on the particular application for the light source.

The light engine 115 further comprises the heat transfer element 160, for example a thermal pad 161, positioned between the rear surface of the circuit board 150 and the housing 120. Preferably, the thermal pad 161 is cooperatively dimensioned with the circuit board 150 and is made of a high thermally conductive material. It may or may not be an electrical insulator, depending on the type of circuit board 150 material used. The thermal pad 161 operates as an electrical insulator when used with conventional fiberglass circuit boards, and is used as an electrically conductive layer when used with aluminum-clad circuit boards. As shown in FIGS. 6 and 12, the circuit board 150 and heat transfer element 160 have an outer periphery less than the inner periphery of the main body portion 145 of the housing 120 to form a gap G there between, wherein the gap G allows for air flow past the modules M and around the periphery of the circuit board 150 and the heat transfer element 160. Due to the configuration of the main body portion 145, the board 150 and the heat transfer element 160, the gap G has a substantially annular shape with a depth that corresponds to the thickness of the board 150 and the element 160. In contrast to existing lighting devices that employ LEDs, the present light fixture 110 does not require a reflector or reflectors to focus or disperse the light pattern generated by the LEDs. As a result, the dimensions of the housing 120 are reduced while still providing a complete light pattern.

Figure 9:
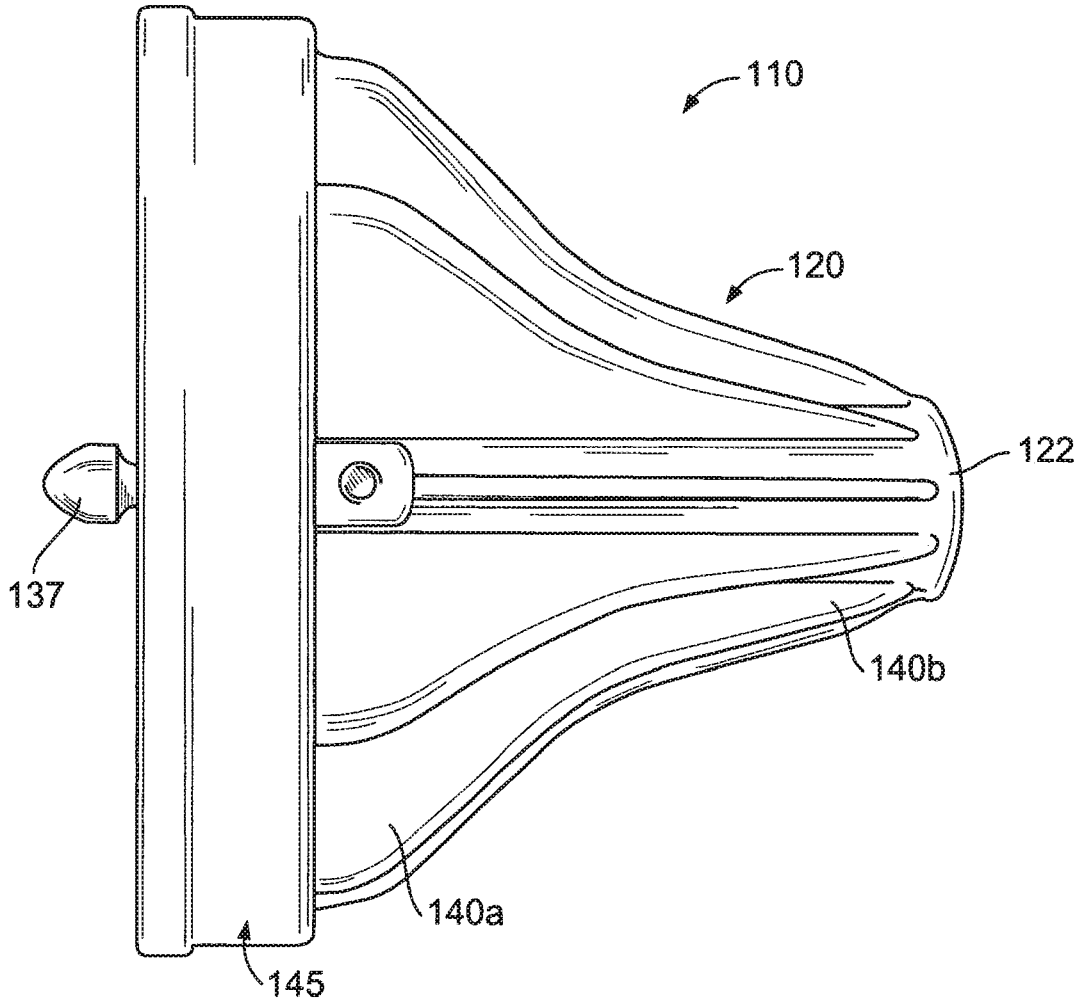
FIG. 9 is a second side view of the light fixture of FIG. 4.

As shown in FIGS. 4 and 9, the light fixture 110 includes an enclosure 300 that receives the power supply 125 wherein the supply 125 is physically separated and thermally isolated from the light fixture 110. Thus, greater operating life can be realized for the power supply 125 as the heat generated by the light engine 115 does not impact the power supply 125. Preferably, the power supply 125 is of the universal input, constant current output and switching variety. The power supply enclosure box 400 may be comprised of an aluminum extruded outer housing 410, aluminum end covers 420, 425, a mounting plate for connection to the main bracket 320, a number of wire strain relief bushings and associated assembly hardware. The input wires 401, 402 and the ground wire 190 extend from a track connector assembly 310 to the power supply 125 within the enclosure 400. The output wires 216, 221 extend from the power supply 125 through the bracket 320 and a spindle aperture 122*a* into the center passageway 136 in order to energize the circuit board 150 and the LED modules M of the light engine 115. Preferably, the first supply lead 216 is electrically connected to a first point P1 of the circuit board 150 and the second supply lead 221 is electrically connected to a second point P2 of the circuit board 150. As shown in FIG. 12, the first and second leads 216, 221 extend through an opening 152 in the circuit board 150 and are then electrically and mechanically connected to the board 150 by at least one connector 153. Preferably, this connection is made within the inner ring of light modules M. Referring to FIG. 4, the light fixture 110, power supply enclosure box 400 and track adapter assembly 310 may are attached to the mounting bracket 320. The bracket 320 may be made from aluminum, and may also be painted or anodized to match the exterior finish of the housing 120. The track connector assembly 310 is employed to connect the light fixture 110 to the elongated track 300, wherein the bracket 320 is capable of being rotated 360 degrees to allow for rotation in the horizontal plane. Due to the connection of the bracket 320 at the housing protrusion 147 with the fastener 230, the light fixture 110 is capable of being rotated 180 degrees to allow for rotation in the vertical plane. The two rotation points allow the direction of the light beam to be set and provide for maximum direction adjustability of the fixture 110. Also, due to the curvature of the bracket 320 and the configuration of the housing 120, the light fixture 110 is balanced on the track system such that the center of mass of the light fixture 110 is directly beneath and securely supported by the track. This balancing aspect minimizes torsion in the track 300 caused by the light fixture 110 as it is adjusted to different positions. Depending upon its configuration, the connector assembly 310 allows the light fixture 110 to be connected to different tracks 300, including one, two, and three circuit tracks 300.

As mentioned above, the light engine assembly 115 comprises the printed circuit board 150 (PCB), at least one LED module M, the heat transfer element 160, and at least one lens 155 extending outward from each module M. The module M is mounted, preferably using solder, to the circuit board 150. The circuit board 150 is round in shape in order to emulate the shape of conventional light sources. In one embodiment, the circuit board 150 is thermal clad, meaning a thin thermally conductive layer bonded to an aluminum or copper substrate, to facilitate heat transfer from the LED modules M through the circuit board 150 and to the housing main body 145 and the fins 140 for dissipation. Aluminum-clad PCBs provide for better thermal performance, as heat is transferred out of the LED modules M through a thermal dielectric layer into an aluminum layer. Alternatively, the circuit board 150 is fabricated from fiberglass material (known as a FR-4 board) and includes thermal vias or pathway to permit heat transfer through the circuit board 150. The circuit board 150 also has a two position "poke-in" style connectors which enables the two leads 216, 221, wither stranded or solid, to be easily and quickly connected from the power supply 125 to the light engine assembly 115. The thermal pad 161 is a heat transfer element 160 with a high thermal conductivity rating to increase the heat transfer from the circuit board 150 to the housing 120. Preferably, the (circular) dimensions of the thermal pad 161 substantially correspond to the dimensions of the circuit board 150 for surface area coverage of and more effective heat transfer from the board 150. In another embodiment, the thermal pad 162 is omitted and the printed circuit board 150 directly contacts the mounting surface 196. In yet another embodiment, the thermal pad 162 is replaced by thermal grease or gel, which is a specially formulated substance that increases heat transfer. The thermal grease may be silicone-based, ceramic-based with suspended ceramic particles, or metal-based with metal particles (typically silver) suspended in other thermally conductive ingredients.

Figure 10:
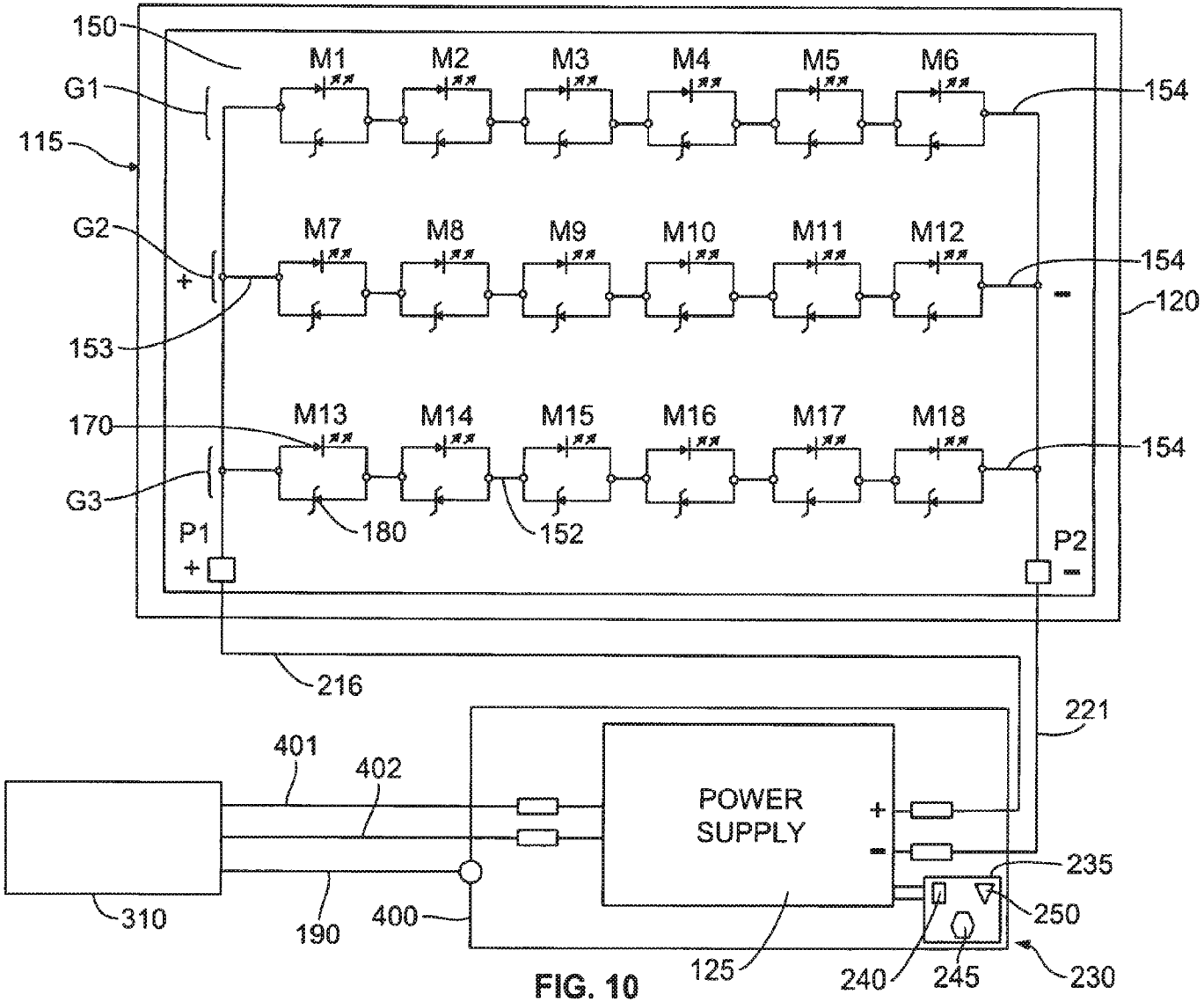
FIG. 10 is an electrical schematic of the light engine of the light fixture of FIG. 4, showing the various LED modules and their components.

Referring to the schematic of FIG. 10, a first embodiment of the light engine 115 has eighteen (180) light modules M1-M18 that are electrically and mechanically coupled to the circuit board 150. In an alternate embodiment (not shown), the light engine 115 includes twenty-four (24) light modules. The light modules M1-M18 include one Watt high brightness LEDs 170, although alternative wattages may be used. The use of multiple one Watt LEDs 170 keeps the total fixture wattage at a minimum, as greater efficiency (Lumen Out per Watts In) can be realized by using multiple lower power LEDs as opposed to fewer higher power LEDs. As shown in FIG. 6, the light modules M are arranged in a circular pattern, with an outer ring of twelve light modules, and an inner ring of six light modules. The light modules in the inner ring are offset in their position with respect to the light modules in the outer ring. The layout is symmetrical so that the light engine 115 may be rotated in either direction 360 degrees without changing the resulting light beam pattern. In addition, the offset arrangement of the light modules M more evenly distributes the heat generated by the light modules into the PCB 150 and housing 120 which maintains the light modules M at lower operating temperatures and yields improved light module operating life.

The light modules M1-M18 are top-mounted on the circuit board 150 and are electrically interconnected by a copper trace 152. Each light module M comprises a LED 170 and a zener diode 180, which results in "bypass" circuitry to prevent catastrophic failure of the light engine 115. The LED 170 is mounted to the board 150 to provide an angle of emission ranging from 75-140 degrees, and preferably 110-120 degrees. In one embodiment, the LED 170 is white and has a color rendition index (which is a measurement of the LED's ability to show true color) of greater than 80 and a color temperature (which is a measurement of warmth or coolness of the light produced by the LED) of roughly 2700-8200 degrees Kelvin (K). In the 2750 K, 3000 K, 3500 K and 4200 K configurations, the LEDs 170 have a warm white quality, and in the 5100 K, 6500 K and 7000 K configurations, the LEDs 170 have a cool white quality. The modules M1-M18 are divided into three groups G1-G3, where each group includes six (6) modules. Within each group G1-G3, the modules M are serially arrayed, and the groups G1-G3 are parallel to each other to facilitate current sharing from the power supply 125. The current sharing provided by the three groups G1-G3 promotes uniform light brightness between the groups G1-G3 and the modules M therein, and maintains constant color temperature of the light produced by the LEDs 170.

Current is supplied from the power supply 125 to the modules M1-M18 by the first or positive supply lead 216, which is electrically connected to the circuit board 150 at the point P1. From there, current is supplied to the primary modules M1, M7 and M13, in each of the three module groupings G1, G2, G3 by supply copper traces 153. Here, each group G1-G3 comprises six modules M, however, each group could comprise a different number of modules M depending upon the desired performance of the light engine 115. The light engine 115 may also comprise an alternate number of groups G. For example, a thirty LED engine may be comprised of five distinct groups, G1-G5 of six modules M. During operation, current flows through the components of the primary modules M1, M7 and M13 and illuminates the LED 170 therein. Current exits the primary modules M1, M7 and M13 along the interconnect trace 152 and proceeds into the secondary modules M2, M8 and M14 to illuminate the LED 170 therein. Current exits the second modules M2, M8 and M14 along the interconnect trace 152 and proceeds into the tertiary modules M3, M9 and M15 to illuminate the LED 170 therein. This current flow sequence continues until exiting the last modules M6, M12 and M18 wherein current flows back to the power supply 125 via return copper traces 54 linked to the second or negative supply lead connected at the point P2.

As briefly mentioned above and as shown in FIG. 10, when the LED 170 modules M1-M18 are serially arrayed, each module M includes a zener diode 180 electrically connected to the LED 170 by a copper trace. In the event the module M includes multiple LEDs 170, then a zener diode is electrically connected to each LED 170. The zener diode and the LED 170 combine to form a "bypass" circuit to prevent catastrophic failure of the light engine 115. The zener diode 180 provides an alternate electrical path, where the diode 180 provides high resistance (essentially an open-circuit) to voltage and current transmission when the LED 170 is operating normally. A zener diode 180 is a type of diode 180 that permits current to flow in the forward direction like a normal diode, but also in the reverse direction if the voltage is larger (not equal to, but larger) than the rated breakdown voltage known as the "zener voltage". In the event the LED 170 malfunctions or fails, the zener diode 180 provides an alternate current path to complete the circuit for that particular module M and the remaining modules M of the light engine 115. In this situation, the voltage drop across the diode 180 is similar to the voltage drop across a properly operating LED 170. Although the diode 180 has no illumination characteristics, it provides an alternate or bypass electrical path to allow the other modules M to remain operational. For example, the fixture 110 has eighteen modules M1-M18, each having a zener diode 180 associated with a LED 170. Assuming the LED 170 in the third module M3 fails, current continues to flow in the bypass path provided by the zener diode 180 and only that particular LED 170 will not be illuminated. As a result, the remaining modules M1, M2 and M4-15 will continue to operate with their respective LED 170 being illuminated. In this manner, the failure of one LED 170 will only affect that particular module M and the remaining modules M in the group G will continue to operate as intended. Without the bypass provided by the zener diode 180, an entire group G of LEDs 170 will lose illumination when just one LED 170 therein fails or malfunctions. In addition to bypass operation, the zener diode 180 helps service technicians to identify a faulty module M, since only that module M will be dark while the other modules M are illuminated. In this manner, replacement and/or upgrade of the modules M is made more efficient and less time consuming.

As mentioned above, the light fixture 110 includes several heat management components, to efficiently dissipate heat generated by the LEDs 170 of the modules M1-M18 and increase the reliability of the fixture 110, including the light engine 115 and the power supply 125. Efficient heat dissipation from the light engine 115 allows for more forward current applied to the LEDs 170, which ensures maximum light output and increased operating life from the modules M1-M18. In addition, minimizing temperature of the LEDs 170 lessens the change in the color wavelength, since the color wavelength varies with temperature. The heat management components include the inlets 142 in the lens cover 135, the internal gap G formed between the board 150 and the main body portion 145, the vent 144, the fins 140 arrayed about the aluminum housing 120 and the thermal pad 161.

During operation and as shown in FIG. 12, heat is generated by the modules M1-M18 and then is transferred along a flow path $F_Q$ for dissipation from the housing 120, to provide a first aspect of heat management. Specifically, a first extent of the heat generated by the modules M is transferred, via conduction, along the flow path $F_Q$ through the circuit board 150 and the thermal pad 161 to the main body 145 and the fins 140, which collectively act as a heat sink. Because the fins 140 are circumferentially arrayed on the main body portion 145, a first quantity of heat from the flow path $F_Q$ is dissipated to ambient through convection from the main body 145, and a second quantity of heat from the flow path $F_Q$ is dissipated to ambient through convection from the fins 140. There is a temperature gradient along the main body 145 to the fins 140 and along the fins 140 themselves, wherein the gradient effectively draws heat from the modules M1-M18 through the main body 145 and the fins 140 to ensure effective heat management and extended operational life of the fixture 110.

The second aspect of the heat management is provided by the interaction of the inlets 142, the gap G and the vents 144, which transfer a second extent of the heat generated by the modules M1-M18, via convection, along the flow path $F_V$. Specifically, ambient air AA (depicted by wavy lines in FIG. 4) enters the fixture 120 through inlets 142 in the lens cover 135, proceeds along flow path $F_V$ across the light engine 115, through the gap G for discharge by the vents 144, wherein the vented air VA is depicted by wavy lines in FIG. 5. In this manner, the flow path $F_V$ provides an internal cooling air flow path through the inlets 142, across the light modules M, across the exposed surface area of the PCB 150 (where the exposed areas result from the spaced arrangement of the modules M), through the internal gap G and out the vents 144 during operation. Although the flow path $F_V$ is shown as generally linear in FIG. 12, it is understood that the flow path $F_V$ is sourced by the array of inlets 142 and comprises branches or sub-paths that extend between and through the offset modules M and across the exposed areas of the PCB 150. Therefore, cooling air is carried by the flow path $F_V$ between the LEDs 170 that generate the heat and that benefit from the convective heat transfer.

The conduction flow path $F_Q$ in combination with convection air flow path $F_V$ provides increased thermal management of the heat generated by the light engine 115 such that no forced air movement is required to ensure the performance and operating life of the light engine 115. As an example, the normal ambient operating range of the light fixture is 20 degrees to 40 degrees Celsius, with a maximum temperature range of −30 degrees to 60 degrees Celsius. The housing 120 also only produces a maximum temperature rise of 40 degrees Celsius above ambient. As an example of the fixture's heat management capabilities during steady state operation, the LED 170 junction temperature at the circuit board 150 was measured at 75° C., the housing 120 body temperature was 65° C., the ambient temperature was 25° C., and the power supply 125 temperature was 40° C. Significantly, the LED 170 junction temperature of 75° C. is far below the 85° C. threshold where initial degeneration begins and the 125° C. level where failure occurs, and the power supply 125 temperature of 40° C. is below the 70° C. threshold where failure may occur. Thus, the fixture's ability to effectively manage the heat generated by the modules M1-M18 provides a number of benefits, including but not limited to, continuous and reliable operation of the light engine 115 and the power supply 125; consistent, high quality light produced by the modules M1-M18; and, efficient operation which leads to lower power consumption and operating costs.

Referring to FIG. 10, the fixture 110 includes a wireless module 230, primarily a radio frequency control unit 235, that allows for remote control of the fixture 110. The radio frequency control unit 235 can be factory assembled into the housing 120 as original equipment, or added to the housing 120 in the field by a service technician. In general terms, the RF control unit 235 allows an operator to remotely turn on, turn off, or adjust the fixture 110 or group of fixture 110*s* to any desired brightness level. The remote interaction resulting from the control unit 235 provides a number of benefits to the fixture 110, including longer operating life for the components, lower energy consumption, and lower operating costs.

The radio frequency control unit 235 comprises a number of components including a transceiver 240 (or separate receiver and transmitter components), an antenna 250, a control interface 245 for the power supply 125, an occupancy sensor (e.g., an infrared occupancy sensor), and a light level sensor or photo control. The control interface 245 includes a connector containing input signals for providing raw power to the control unit 235, as well as output signals for controlling the power supply 125 itself. In operation, the control unit 235 interacts with the power supply 125 to allow an operator to power on, power off, or dim the brightness of the fixture 110. To ensure reception of the operating signals, the control unit 235 utilizes an embedded antenna 250, or an external antenna 250 coupled to the housing 120 for better wireless reception. The radio frequency control unit 235 can receive commands from a centralized controller, such as that provided by a local network, or from another control module positioned in a fixture 110 in close proximity. Thus, the range of the lighting network could be extended via the relaying and/or repeating of control commands between control units 235.

In a commercial facility or building having multiple fixtures 110, each fixture 110 may be assigned a radio frequency (RF) address or identifier, or a group of fixtures 110 are assigned the same RF address. An operator interfacing with a lighting control network can then utilize the RF address to selectively control the operation and/or lighting characteristics of all fixtures 110, a group of fixtures 110, or individual fixtures 110 within the store. For example, all fixtures 110 having an RF address corresponding to a specific function or location within the store, such as the loading dock or shipping point, can be full-range dimmed (meaning, dimmed to various levels) or turned off when the store is closed for the evening. The operator can be located within the store and utilize a hand held remote to control the group of fixtures 110 and/or individual fixture 110. Alternatively, the operator may utilize a personal digital assistant (PDA), a computer, or a cellular telephone to control the fixtures 110. In a broader context where stores are located across a broad geographic region, for example across a number of states or a country, the fixtures 110 in all stores may be linked to a lighting network. A network operator can then utilize the RF address to control: (a) all fixtures 110 linked to the network; (b) the fixtures 110 on a facility-by-facility basis; and/or (c) groups of fixtures 110 within a facility or collection of facilities based upon the lighting function of the fixtures 110.

A centralized lighting controller that operably controls the fixtures 110 via the control units 235 can be configured to interface with an existing building control system or lighting control system. The central lighting controller may already be part of an existing building control system or lighting control system, wherein the fixture 110 and the control unit 235 are added as upgrades. The radio frequency control unit 235 could utilize a proprietary networking protocol, or use a standard networking control protocol. For example, standard communication protocols include Zigbee, Bluetooth, IEEE 802.11, Lonworks, and Backnet protocols.

Figure 13:
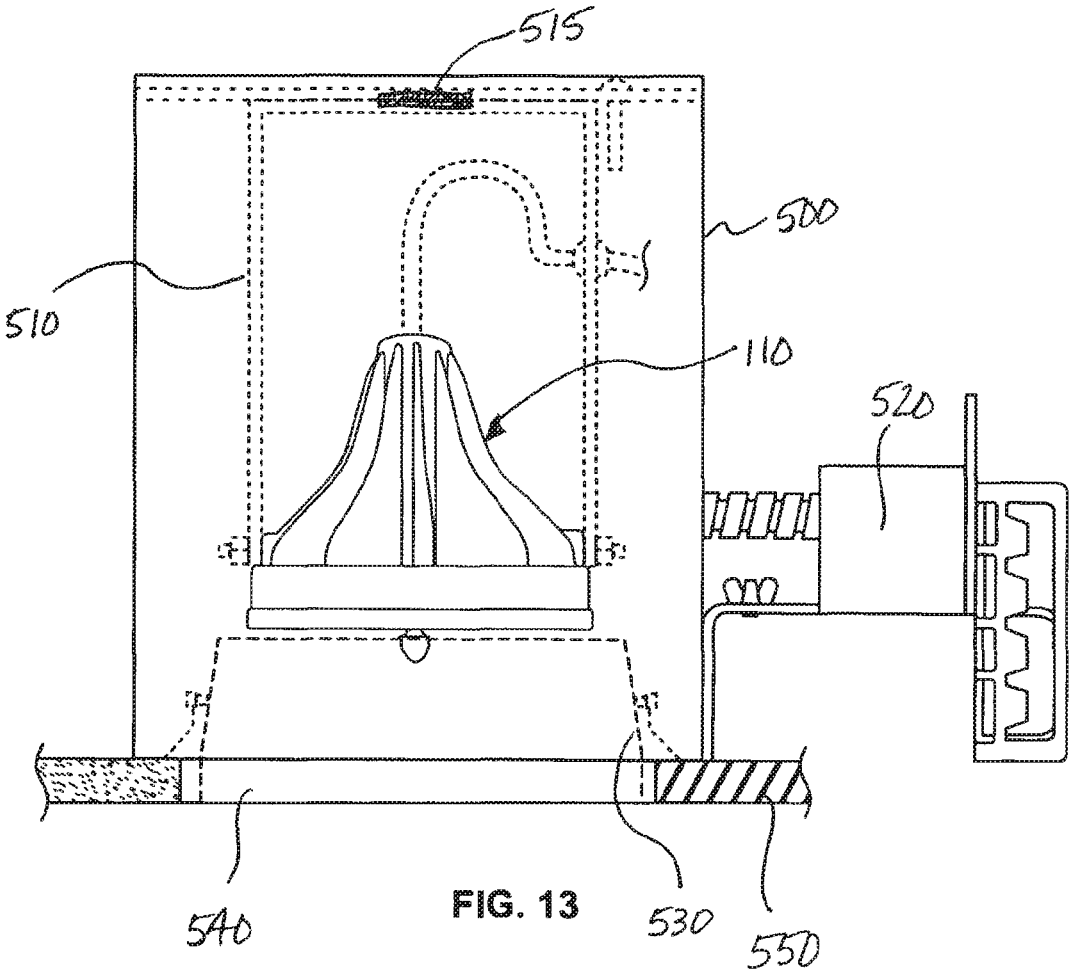

In an another embodiment, the circular configuration of the light fixture 110, namely provided by the housing 120, the light engine 115, the spindle 122 and the fins 140, allows the light fixture 110 to be used in retrofit applications, where conventional light sources are replaced with solid state light sources. Examples of this include indoor down light fixtures and outdoor walkway lamp post fixtures. The light fixture 110 may be connected to the prevalent recessed down-light housings, including the six inch diameter versions that are found in residential and the larger versions found in commercial installations. As an example, FIG. 13 shows the fixture 110 installed in a down light housing 500 with a first adjustable bracket 510 (which may include torsion spring clips) and second adjustable bracket 515. The first adjustable bracket 510 allows for pivotal movement about an axis that is substantially horizontal to the ceiling 550 and a longitudinal axis to the housing 500. The second adjustable bracket 515 allows for pivotal movement about an axis that is substantially aligned with the longitudinal axis of the housing 500 and the longitudinal axis of the central passageway 136. Electrical connection can be made by using an "Edison base" lampholder adapter and external power supply 520. The fixture 110 is positioned above a reflector cup 530 and provides light through an opening 540 in the ceiling 550 to which the housing 500 is mounted. This connection approach allows for easy retrofitting and replacement of older incandescent technology with more efficient LED technology, and allow for adapting to the majority of down-light housings already installed throughout the world.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A LED light fixture for use in commercial lighting settings, the LED light fixture comprising:

a housing including a main body portion with a frontal flange, an internal receiver, and an array of fins extending rearward from the flange to define a rear receptacle that extends rearward from the flange, the housing further including a rear cover that encloses the rear receptacle;

a light engine assembly mounted to the internal receiver, the light engine assembly having a plurality of light modules, wherein each light module includes both a LED mounted to a printed circuit board and an optical lens extending from the printed circuit board;

a frontal lens cover affixed to the flange of the housing; and, a power supply residing within the rear receptacle and enclosed by the rear cover.

2. The LED light fixture of claim 1, wherein during operation, heat generated by the LEDs passes through the circuit board and then said heat is dissipated by the array of fins without the use of a fan.

3. The LED light fixture of claim 1, the housing having a side wall arrangement that extends rearward from the flange, wherein the side wall arrangement has a rectangular periphery that provides the housing with a rectangular configuration.

4. The LED light fixture of claim 3, the housing further comprising a pair of opposed protrusions positioned along the side wall arrangement, wherein each protrusion is configured to receive a fastener to couple with a mounting bracket that secures the LED light fixture to a supporting structure.

5. The LED light fixture of claim 1, wherein the frontal flange defines a first internal mounting surface that is recessed from a frontal edge of the frontal flange.

6. The LED light fixture of claim 5, wherein the frontal lens cover is received by the first internal mounting surface of the frontal flange.

7. The LED light fixture of claim 1, wherein the light modules are arranged in distinct groups.

8. The LED light fixture of claim 1, wherein the fins are arrayed such that there is a gap between adjacent fins.

9. The LED light fixture of claim 1, further comprising a separate box to enclose the power supply, said box residing within the rear receptacle, the rear cover operably connected to said box.

10. The LED light fixture of claim 9, wherein the box includes a front wall that is secured to at least one boss that extends between a rear wall of the main body and the front wall of the box.

11. The LED light fixture of claim 10, wherein the boss has an elongated configuration and is positioned among the fin array.

* * * * *